US009327413B2

(12) United States Patent
Sakai

(10) Patent No.: US 9,327,413 B2
(45) Date of Patent: May 3, 2016

(54) FOLDING KNIFE WITH A TWO-PIECE BACKLOCK

(71) Applicant: Spyderco, Inc., Golden, CO (US)

(72) Inventor: Kimiyuki Sakai, Seki (JP)

(73) Assignee: Spyderco, Inc., Golden, CO (US)

( * ) Notice: Subject to any disclaimer, the term of this patent is extended or adjusted under 35 U.S.C. 154(b) by 107 days.

(21) Appl. No.: 14/076,867

(22) Filed: Nov. 11, 2013

(65) Prior Publication Data

US 2015/0128426 A1 May 14, 2015

(51) Int. Cl.
*B26B 5/00* (2006.01)
*B26B 1/04* (2006.01)

(52) U.S. Cl.
CPC ..... *B26B 1/042* (2013.01)

(58) Field of Classification Search
USPC ..... 30/155, 160, 161
See application file for complete search history.

(56) References Cited

U.S. PATENT DOCUMENTS

| | | | | |
|---|---|---|---|---|
| 492,084 | A | | 2/1893 | Brigham |
| 552,077 | A | | 12/1895 | Wagner |
| 557,818 | A | | 4/1896 | Hotchkiss |
| 589,737 | A | | 9/1897 | Miller |
| 589,738 | A | | 9/1897 | Miller |
| 600,442 | A | | 3/1898 | Nell |
| 698,080 | A | | 4/1902 | Treas |
| 736,525 | A | | 8/1903 | Kaufmann |
| 749,230 | A | | 1/1904 | Severance |
| 845,130 | A | | 2/1907 | Schrade |
| 988,068 | A | | 3/1911 | Beardsley et al. |
| 1,030,058 | A | | 6/1912 | Doles |
| 1,194,503 | A | | 8/1916 | Jawoisch |
| 1,362,142 | A | | 12/1920 | Rohrer |
| 1,614,949 | A | | 1/1927 | Finley |
| 1,803,899 | A | | 5/1931 | Fuller |
| 1,864,011 | A | | 6/1932 | Brown |
| 1,994,215 | A | | 3/1935 | Gaunt |
| 2,098,678 | A | | 11/1937 | Schrade |
| 2,263,415 | A | * | 11/1941 | Berg et al. ..... 30/160 |
| 2,415,367 | A | | 2/1947 | Pavlovic |
| 2,461,941 | A | | 2/1949 | Sutton |
| 2,481,309 | A | | 9/1949 | Gunnarson |
| D166,064 | S | | 3/1952 | Blecher |

(Continued)

FOREIGN PATENT DOCUMENTS

| | | |
|---|---|---|
| CA | 1130567 | 8/1982 |
| DE | 3041584 | 6/1982 |

(Continued)

OTHER PUBLICATIONS

U.S. Appl. No. 14/542,076, filed Nov. 14, 2014, Glesser.

(Continued)

*Primary Examiner* — Omar Flores Sanchez
(74) *Attorney, Agent, or Firm* — Sheridan Ross P.C.

(57) ABSTRACT

A locking mechanism for a folding knife is provided. More specifically, the locking mechanism is a two-piece backlock that maintains the folding knife's extended position and prevents the blade from inadvertently closing when the knife is in use in the extended position and impedes the folding knife from inadvertently opening when the knife is in a closed position of storage. The locking mechanism generally comprises a backlock, a toggle, and a biasing member. The toggle rotates between two positions and engages with the tang of the blade and the backlock.

19 Claims, 7 Drawing Sheets

(56) References Cited

U.S. PATENT DOCUMENTS

| | | | |
|---|---|---|---|
| 2,630,114 | A | 3/1953 | Hart |
| 2,889,621 | A | 6/1959 | Bassett |
| 3,006,443 | A | 10/1961 | Siler |
| 3,263,329 | A | 8/1966 | Hennessy |
| D224,388 | S | 7/1972 | Wood |
| D224,389 | S | 7/1972 | Wood |
| 3,731,961 | A | 5/1973 | Becker |
| D227,071 | S | 6/1973 | Bernedotte |
| 3,783,509 | A | 1/1974 | Lake |
| 3,871,141 | A | 3/1975 | Bonapace |
| D237,458 | S | 11/1975 | Laughlin |
| 3,930,309 | A | 1/1976 | Collins |
| 3,942,394 | A | 3/1976 | Juranitch |
| 4,040,181 | A | 8/1977 | Johnson |
| 4,070,011 | A | 1/1978 | Glesser |
| 4,083,110 | A | 4/1978 | Goldin et al. |
| 4,124,939 | A | 11/1978 | Onoue |
| 4,133,106 | A | 1/1979 | Addis |
| 4,170,061 | A | 10/1979 | Henry |
| D256,427 | S | 8/1980 | Lile |
| D256,981 | S | 9/1980 | Sakurai |
| D257,056 | S | 9/1980 | Spivey |
| 4,231,194 | A | 11/1980 | Glesser |
| D257,612 | S | 12/1980 | Goldin et al. |
| 4,240,201 | A | 12/1980 | Sawby et al. |
| 4,266,591 | A | 5/1981 | F'Geppert |
| 4,272,887 | A | 6/1981 | Poehlmann |
| 4,274,200 | A | 6/1981 | Coder |
| 4,347,665 | A | 9/1982 | Glesser |
| 4,356,631 | A | 11/1982 | Guth |
| 4,393,539 | A | 7/1983 | Weissman |
| 4,394,096 | A | 7/1983 | Stevens |
| 4,408,394 | A | 10/1983 | Phelps |
| 4,447,950 | A | 5/1984 | Mizelle |
| 4,451,982 | A | 6/1984 | Collins |
| D275,448 | S | 9/1984 | Ferraro |
| 4,535,539 | A | 8/1985 | Friedman et al. |
| D280,427 | S | 9/1985 | Jones |
| 4,604,803 | A | 8/1986 | Sawby |
| 4,640,058 | A | 2/1987 | Glesser |
| D288,898 | S | 3/1987 | Osterhout |
| 4,696,129 | A | 9/1987 | Roberts |
| 4,697,673 | A | 10/1987 | Omata |
| 4,703,560 | A | 11/1987 | Brooker |
| 4,719,700 | A | 1/1988 | Taylor, Jr. |
| 4,730,393 | A | 3/1988 | Coburn |
| D296,518 | S | 7/1988 | Sadler |
| 4,759,153 | A | 7/1988 | Cohen |
| 4,776,094 | A | 10/1988 | Glesser |
| 4,778,094 | A | 10/1988 | Fishback |
| 4,805,303 | A | 2/1989 | Gibbs |
| 4,811,486 | A | 3/1989 | Cunningham |
| 4,819,289 | A | 4/1989 | Gibbs |
| D302,649 | S | 8/1989 | Porsche et al. |
| D302,650 | S | 8/1989 | Giordano |
| D302,934 | S | 8/1989 | Finn |
| D303,210 | S | 9/1989 | Thompson |
| D304,154 | S | 10/1989 | Osterhout |
| 4,901,439 | A | 2/1990 | Boyd, Jr. |
| D310,014 | S | 8/1990 | Inman |
| 4,947,551 | A | 8/1990 | Deisch |
| 4,947,552 | A | 8/1990 | Barnes |
| D310,621 | S | 9/1990 | Thompson |
| 4,974,323 | A | 12/1990 | Cassady |
| 4,985,998 | A | 1/1991 | Howard |
| D317,037 | S | 5/1991 | Koshiishi |
| 5,044,079 | A | 9/1991 | Gibbs |
| 5,060,379 | A | 10/1991 | Neely |
| 5,060,890 | A | 10/1991 | Utterback et al. |
| D321,820 | S | 11/1991 | Russell |
| D324,899 | S | 3/1992 | Thompson |
| 5,093,995 | A | 3/1992 | Jan |
| 5,095,624 | A | 3/1992 | Ennis |
| 5,111,581 | A | 5/1992 | Collins |
| 5,131,149 | A | 7/1992 | Thompson et al. |
| 5,153,995 | A | 10/1992 | Opinel |
| D333,081 | S | 2/1993 | Glesser |
| D333,251 | S | 2/1993 | Glesser |
| D333,859 | S | 3/1993 | Meyer |
| D337,253 | S | 7/1993 | Glesser |
| D344,006 | S | 2/1994 | Glesser |
| 5,293,690 | A | 3/1994 | Cassady |
| D347,375 | S | 5/1994 | Sakai |
| D348,599 | S | 7/1994 | Sakai |
| 5,325,588 | A | 7/1994 | Rogers |
| D349,837 | S | 8/1994 | Glesser |
| D353,988 | S | 1/1995 | Glesser |
| 5,379,492 | A | 1/1995 | Glesser |
| D356,723 | S | 3/1995 | Sakai |
| 5,400,509 | A | 3/1995 | Collins |
| 5,425,175 | A | 6/1995 | Rogers |
| D363,871 | S | 11/1995 | Coggins |
| D365,266 | S | 12/1995 | Hasegawa |
| D366,408 | S | 1/1996 | Sessions et al. |
| D367,599 | S | 3/1996 | Sakai |
| 5,495,673 | A | 3/1996 | Gardiner et al. |
| 5,495,674 | A | 3/1996 | Taylor, Jr. |
| 5,502,895 | A | 4/1996 | Lemaire |
| 5,511,310 | A | 4/1996 | Sessions et al. |
| 5,515,610 | A | 5/1996 | Levin et al. |
| 5,537,750 | A | 7/1996 | Seber et al. |
| 5,542,139 | A | 8/1996 | Boivin |
| 5,546,662 | A | 8/1996 | Seber et al. |
| D373,716 | S | 9/1996 | Keys et al. |
| 5,572,793 | A | 11/1996 | Collins et al. |
| 5,580,019 | A | 12/1996 | Glesser |
| 5,581,888 | A | 12/1996 | Lewis |
| D377,443 | S | 1/1997 | Seber et al. |
| 5,594,966 | A | 1/1997 | Goldman |
| 5,596,808 | A | 1/1997 | Lake et al. |
| D378,982 | S | 4/1997 | Thompson |
| 5,615,484 | A | 4/1997 | Pittman |
| D379,294 | S | 5/1997 | Lum |
| 5,628,117 | A | 5/1997 | Glesser |
| D379,579 | S | 6/1997 | Pohl |
| D381,060 | S | 7/1997 | Moran |
| D382,189 | S | 8/1997 | Viele |
| D382,459 | S | 8/1997 | Khalsa |
| 5,661,908 | A | 9/1997 | Chen |
| D384,871 | S | 10/1997 | McWillis |
| D385,173 | S | 10/1997 | McWillis |
| D386,664 | S | 11/1997 | Glesser |
| 5,685,079 | A | 11/1997 | Brothers et al. |
| 5,689,890 | A | 11/1997 | Glesser |
| D387,966 | S | 12/1997 | Horn |
| D388,150 | S | 12/1997 | Glesser |
| D389,389 | S | 1/1998 | Glesser |
| D389,718 | S | 1/1998 | Wegner |
| 5,704,129 | A | 1/1998 | Glesser |
| D391,465 | S | 3/1998 | Glesser |
| D392,539 | S | 3/1998 | Balolia |
| 5,722,168 | A | 3/1998 | Huang |
| 5,737,841 | A | 4/1998 | McHenry et al. |
| 5,755,035 | A | 5/1998 | Weatherly |
| 5,765,247 | A | 6/1998 | Seber et al. |
| D396,657 | S | 8/1998 | Nagai et al. |
| D397,017 | S | 8/1998 | Pardue |
| D397,020 | S | 8/1998 | Pardue |
| 5,794,346 | A | 8/1998 | Seber et al. |
| 5,799,400 | A | 9/1998 | Glesser |
| 5,822,866 | A | 10/1998 | Pardue |
| 5,826,340 | A | 10/1998 | Hull |
| D402,178 | S | 12/1998 | Glesser |
| D402,524 | S | 12/1998 | Glesser |
| D403,567 | S | 1/1999 | Glesser |
| D404,990 | S | 2/1999 | Zowada |
| D405,338 | S | 2/1999 | Balolia |
| D407,002 | S | 3/1999 | Morton et al. |
| 5,878,500 | A | 3/1999 | Emerson |
| 5,887,347 | A | 3/1999 | Gibbs |
| D408,706 | S | 4/1999 | Elishewitz |
| D409,070 | S | 5/1999 | Elishewitz |
| D411,431 | S | 6/1999 | Glesser |
| D411,790 | S | 7/1999 | Glesser |

(56) References Cited

U.S. PATENT DOCUMENTS

| | | | |
|---|---|---|---|
| D412,355 | S | 7/1999 | Saetherbo |
| 5,920,935 | A | 7/1999 | Beck |
| 5,953,821 | A | 9/1999 | Mearns |
| 5,964,036 | A | 10/1999 | Centofante |
| 5,983,506 | A | 11/1999 | Glesser |
| D418,383 | S | 1/2000 | Bradichansky |
| D421,378 | S | 3/2000 | Glesser |
| D422,476 | S | 4/2000 | McHenry et al. |
| D422,477 | S | 4/2000 | Elishewitz |
| D422,478 | S | 4/2000 | Elishewitz |
| D422,479 | S | 4/2000 | Pardue |
| D422,480 | S | 4/2000 | McHenry et al. |
| D422,669 | S | 4/2000 | Elishewitz |
| D422,871 | S | 4/2000 | Terzuola |
| D422,873 | S | 4/2000 | McHenry et al. |
| D422,877 | S | 4/2000 | Elishewitz |
| D425,389 | S | 5/2000 | Elishewitz |
| D425,391 | S | 5/2000 | Bradichansky |
| D426,132 | S | 6/2000 | Pardue |
| 6,088,861 | A | 7/2000 | Sessions et al. |
| D428,789 | S | 8/2000 | McHenry et al. |
| D429,138 | S | 8/2000 | Glesser |
| 6,101,722 | A | 8/2000 | Cheng |
| 6,101,723 | A | 8/2000 | Ford |
| 6,101,724 | A | 8/2000 | Halligan |
| 6,122,829 | A | 9/2000 | McHenry et al. |
| D431,991 | S | 10/2000 | Elishewitz |
| D432,386 | S | 10/2000 | Elishewitz |
| 6,125,543 | A | 10/2000 | Jhones |
| D433,913 | S | 11/2000 | Pardue |
| D434,631 | S | 12/2000 | Lum |
| D435,420 | S | 12/2000 | Ayoob |
| 6,154,965 | A | 12/2000 | Sakai |
| D436,014 | S | 1/2001 | Glesser |
| 6,170,104 | B1 | 1/2001 | Seber et al. |
| D438,442 | S | 3/2001 | Osborne |
| D438,443 | S | 3/2001 | Keating |
| 6,205,667 | B1 | 3/2001 | Glesser |
| D441,827 | S | 5/2001 | Frank |
| D442,460 | S | 5/2001 | Glesser |
| D442,461 | S | 5/2001 | Glesser |
| D442,841 | S | 5/2001 | Balolia |
| 6,305,085 | B1 | 10/2001 | Stallegger et al. |
| 6,308,420 | B1 | 10/2001 | Moser |
| 6,314,646 | B1 | 11/2001 | Schmidt |
| 6,338,431 | B1 | 1/2002 | Onion |
| 6,360,443 | B1 | 3/2002 | Remus |
| 6,363,615 | B1 | 4/2002 | Moser |
| 6,370,778 | B1 | 4/2002 | Conable |
| 6,378,214 | B1 | 4/2002 | Onion |
| 6,397,477 | B1 | 6/2002 | Collins |
| D461,387 | S | 8/2002 | Glesser |
| 6,427,335 | B1 | 8/2002 | Ralph |
| 6,430,816 | B2 | 8/2002 | Neveux |
| 6,438,848 | B1 | 8/2002 | McHenry et al. |
| D464,551 | S | 10/2002 | Glesser |
| 6,490,797 | B1 | 12/2002 | Lake et al. |
| 6,523,265 | B2 | 2/2003 | Eickhorn |
| 6,553,672 | B2 | 4/2003 | Glesser et al. |
| D474,669 | S | 5/2003 | Onion |
| 6,574,869 | B1 | 6/2003 | Williams et al. |
| 6,591,505 | B2 | 7/2003 | Flavigny |
| 6,618,947 | B1 | 9/2003 | Gardiner et al. |
| 6,675,484 | B2 | 1/2004 | McHenry et al. |
| 6,701,621 | B2 | 3/2004 | Kain et al. |
| 6,725,545 | B2 | 4/2004 | Frank |
| 6,732,436 | B2 | 5/2004 | Moizis |
| 6,751,868 | B2 | 6/2004 | Glesser |
| D495,940 | S | 9/2004 | Keppel et al. |
| 6,789,323 | B2 | 9/2004 | Moizis |
| 6,836,967 | B1 | 1/2005 | Sakai |
| 6,918,184 | B2 | 7/2005 | Glesser |
| D509,124 | S | 9/2005 | Keppel et al. |
| 6,941,661 | B2 | 9/2005 | Frazer |
| 6,959,494 | B2 | 11/2005 | Taylor |
| 7,032,315 | B1 | 4/2006 | Busse |
| D520,843 | S | 5/2006 | Voros |
| 7,051,441 | B2 | 5/2006 | Carter, III |
| D523,317 | S | 6/2006 | Ryan et al. |
| 7,059,053 | B2 | 6/2006 | Sakai |
| 7,146,736 | B1 | 12/2006 | Collins |
| 7,243,430 | B1 | 7/2007 | Lerch |
| 7,249,417 | B2 | 7/2007 | Chu |
| D553,467 | S | 10/2007 | Ryan |
| 7,293,360 | B2 | 11/2007 | Steigerwalt et al. |
| 7,305,768 | B2 | 12/2007 | Hinderer |
| 7,305,769 | B2 | 12/2007 | McHenry et al. |
| 7,313,866 | B2 | 1/2008 | Linn et al. |
| 7,340,836 | B2 | 3/2008 | Whitemiller et al. |
| D573,864 | S | 7/2008 | Glesser |
| 7,406,896 | B2 | 8/2008 | Rivera |
| 7,409,766 | B2 | 8/2008 | Steigerwalt |
| 7,437,822 | B2 | 10/2008 | Flagg et al. |
| D581,240 | S | 11/2008 | Glesser et al. |
| 7,458,159 | B2 * | 12/2008 | Galyean et al. ..... 30/160 |
| 7,533,466 | B2 | 5/2009 | Steigerwalt |
| 7,543,386 | B2 | 6/2009 | Sullivan |
| 7,555,839 | B2 | 7/2009 | Koelewyn |
| 7,562,454 | B2 | 7/2009 | Steigerwalt et al. |
| 7,562,455 | B2 | 7/2009 | McHenry et al. |
| 7,627,951 | B2 | 12/2009 | Glesser et al. |
| 7,676,931 | B2 | 3/2010 | Knight et al. |
| 7,676,932 | B2 | 3/2010 | Grice |
| RE41,259 | E | 4/2010 | McHenry et al. |
| 7,694,421 | B2 | 4/2010 | Lin |
| 7,774,940 | B2 | 8/2010 | Frank |
| 7,905,023 | B2 | 3/2011 | Westerfield |
| 7,918,028 | B2 | 4/2011 | Steigerwalt et al. |
| 7,987,601 | B2 | 8/2011 | Nakamura |
| 8,042,276 | B2 | 10/2011 | Lerch et al. |
| 8,082,671 | B2 | 12/2011 | Saegesser |
| 8,161,653 | B2 * | 4/2012 | Nenadic ..... 30/161 |
| 8,296,958 | B1 * | 10/2012 | Frazer ..... 30/161 |
| 8,375,590 | B2 | 2/2013 | Duey |
| 8,505,206 | B2 | 8/2013 | VanHoy |
| 8,607,460 | B1 | 12/2013 | Lerch et al. |
| 8,745,878 | B2 | 6/2014 | Glesser et al. |
| 8,978,253 | B2 | 3/2015 | Snyder et al. |
| 2001/0022113 | A1 | 9/2001 | Kojima et al. |
| 2001/0023541 | A1 | 9/2001 | Blanchard |
| 2003/0019108 | A1 | 1/2003 | McHenry et al. |
| 2004/0154169 | A1 | 8/2004 | McCann |
| 2004/0244205 | A1 | 12/2004 | Linn et al. |
| 2006/0064877 | A1 | 3/2006 | Vallotton et al. |
| 2006/0123632 | A1 | 6/2006 | Linn et al. |
| 2006/0168817 | A1 | 8/2006 | Kao |
| 2006/0168819 | A1 | 8/2006 | Perreault |
| 2006/0272158 | A1 | 12/2006 | Williams |
| 2008/0201953 | A1 | 8/2008 | Bremer et al. |
| 2008/0222896 | A1 | 9/2008 | Marfione et al. |
| 2008/0289198 | A1 | 11/2008 | Kaiser et al. |
| 2009/0056146 | A1 | 3/2009 | Duey |
| 2009/0144986 | A1 | 6/2009 | Frazer |
| 2009/0183374 | A1 | 7/2009 | Kao |
| 2009/0193664 | A1 | 8/2009 | Galyean |
| 2009/0223061 | A1 | 9/2009 | Seber et al. |
| 2009/0271989 | A1 | 11/2009 | VanHoy |
| 2010/0236078 | A1 | 9/2010 | Duey |
| 2010/0299934 | A1 | 12/2010 | VanHoy |
| 2013/0125403 | A1 | 5/2013 | Westerfield |
| 2013/0233113 | A1 | 9/2013 | Saitoh |
| 2013/0263455 | A1 | 10/2013 | Collins et al. |
| 2013/0283621 | A1 | 10/2013 | Snyder et al. |
| 2013/0305541 | A1 | 11/2013 | Koenig |
| 2014/0047718 | A1 | 2/2014 | Fellows et al. |
| 2014/0115899 | A1 * | 5/2014 | Frazer ..... 30/160 |
| 2014/0373364 | A1 | 12/2014 | Li |

FOREIGN PATENT DOCUMENTS

| | | |
|---|---|---|
| DE | 3217529 | 1/1983 |
| DE | 3834295 | 7/1989 |
| FR | 2495-986 | 6/1982 |
| GB | 189822620 | 12/1898 |

(56) References Cited

FOREIGN PATENT DOCUMENTS

| | | |
|---|---|---|
| GB | 753590 | 7/1956 |
| GB | 2084058 | 4/1982 |
| JP | S56-175905 | 12/1981 |
| JP | H09-108456 | 4/1997 |
| JP | H09-511408 | 11/1997 |
| WO | WO9511116 | 4/1995 |

OTHER PUBLICATIONS

"Dear Spyderco Customer" Letter from Spyderco, Inc., Nov. 1, 2006, 2 pages.
"Ironstone," Catalog of Knives and Accessories, Fall/Winter 1995-1996, cover, pp. 6-7 and 10-13.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://www.shop.com/K_I_S_S_Knife_from_Columbia_River_Knife_and_Tool-33217878-p!.shtml, dated Jun. 2, 2008, 3 pages.
"Spyderco 2001 Dealer Catalog," Spyderco, Inc., 2001, Part 1, pp. 1-20.
"Spyderco 2001 Dealer Catalog," Spyderco, Inc., 2001, Part 2, pp. 21-40.
"Spyderco 2001," Spyderco, Inc. 2001, 2 pages.
"Spyderco 2002," Spyderco, Inc. 2002, 3 pages.
"Spyderco 2007 Dealer Pricing," Spyderco, Inc., 2007, 4 pages.
"Spyderco 2007 Product Guide," Spyderco, Inc., 2007, Part 1, pp. 1-24.
"Spyderco 2007 Product Guide," Spyderco, Inc., 2007, Part 2, pp. 25-48.
"Spyderco 2007 Product Guide," Spyderco, Inc., 2007, Part 3, pp. 49-74.
"Spyderco 'CLIPITSTM' Flip Open With One Hand," date unknown, p. 28.
"Spyderco Think About It . . . All God's Critters Have Knives," Spyderco, Inc. 1996, 26 pages.
"Spyderco Y2K Dealer Catalog," Spyderco, Inc., 2000, Part 1, pp. 1-17.
"Spyderco Y2K Dealer Catalog," Spyderco, Inc., 2000, Part 2, pp. 18-36.
"SpyderEdge," Spyderco, Inc., 4th Quarter, 2001, pp. 1-6.
"The Bud K Catalog," Bud K Worldwide, Early Fall 2000, p. 3, front and back cover.
"To Our Valuable Distributors and Dealers," Letter from Spyderco, Inc., Nov. 1, 2006, 4 pages.
"Welcome to the World of Spyderco," Spyderco Brochure, Spyderco, Inc., 1998, 42 pages.
"Benchmade 2003 Catalog," Axis Lock, 17 pages.
SOG Knives, Vision, retreived from http://web.archive.org/web/20020127064214/http://www.sogknives.com/vision.htm, Jan. 27, 2002, 1 page.
SOG Knives, X-ray Vision, retrived from http://web.archive.org/web/20011208114647/http://www.sogknives.com/xrayvis.htm, Dec. 8, 2001, 1 page.
SOG Knives, Mini X-Ray Vision, retrieved from http://web.archive.org/web/20011211023306/http://www.sogknives.com/minxrvis.htm, Dec. 11, 2001, 1 page.
SOG Knives, Night Vision, retrieved from http://web.archive.org/web/20011208113219/http://www.sogknives.com/nightvis.htm, Dec. 8, 2001, 1 page.
SOG Knives, Sculpture, retrieved from http://web.archive.org/web/20011211022847/http://www.sogknives.com/sculpt.htm, Dec. 11, 2001, 1 page.
Office Action for U.S. Appl. No. 12/244,151 mailed Feb. 15, 2011, 7 pages.
Office Action for U.S. Appl. No. 12/244,151 mailed Nov. 8, 2011, 8 pages.
Office Action for U.S. Appl. No. 12/244,151 mailed Mar. 28, 2013, 6 pages.
Office Action for U.S. Appl. No. 12/244,151 mailed Oct. 23, 2013, 6 pages.
Notice of Allowance for U.S. Appl. No. 12/244,151 mailed Jan. 22, 2014, 5 pages.
Office Action for U.S. Appl. No. 11/759,103, mailed Jan. 12, 2009, 12 pages.
Notice of Allowance for U.S. Appl. No. 11/759,103, mailed Jul. 28, 2009, 14 pages.
Official Action for U.S. Appl. No. 13/460,370, mailed Jun. 19, 2015 14 pages.
Official Action for U.S. Appl. No. 13/460,401, mailed Apr. 24, 2014 8 pages.
Notice of Allowance for U.S. Appl. No. 13/460,401, mailed Nov. 17, 2014 7 pages.
Official Action for U.S. Appl. No. 13/460,370, mailed Dec. 15, 2015 18 pages.

* cited by examiner

FOLDING KNIFE WITH A TWO-PIECE BACKLOCK

FIELD OF THE INVENTION

The present invention relates to cutting instruments and more specifically to folding knives with locking mechanisms to maintain extended positions of use associated with the folding knives.

BACKGROUND OF THE INVENTION

Cutting instruments have been used for centuries by craftsmen, hunters, and others requiring a sharp cutting instrument. More recently, fixed length knives have been replaced with popular folding knives, which generally have two positions. In an open or extended position of use, the knife cutting blade is extended to expose the blade cutting edge and permit cutting therein. In a closed position, the cutting edge of the blade is stored within a cavity or recess in the handle portion of the knife, thus preventing the blade from being exposed. The folding knife further provides a cutting instrument which is much shorter in length than a typical fixed blade knife. Although these types of knives are extremely convenient, they can potentially become dangerous if the cutting blade does not have a locking mechanism to securely keep the knife blade in the first extended position of use. U.S. Pat. No. 6,751,868 discloses a folding knife with a substantially spherical locking mechanism, and is incorporated by reference herein in its entirety.

In particular, providing a locking mechanism comprising a strategically positioned two-piece backlock that engages the tang of the blade, which allows for travel between a first locked position and a second closed position without the need for other internal housing members, is desired.

Although there are other types of locking mechanisms used to prevent the inadvertent closure of a folding knife blade, such as a liner lock or a single piece backlock, many of these locking mechanisms are not simplistic to use, are expensive to manufacture, or are prone to failure. Thus, there is a need for a type of folding knife locking mechanism which overcomes these pitfalls and is simplistic to use, inexpensive to manufacture, and provides substantial strength to prevent any inadvertent failure. More specifically, by utilizing a toggle oriented to engage a stop surface of the blade tang, a folding knife with superior strength characteristics can be manufactured, and with improved compressive strength. There is also a need for an improved folding knife locking mechanism that is simplistic to assemble, uses a minimum number of components, and is extremely reliable to prevent the inadvertent closure of the knife blade. There is an additional need for a two-piece backlock that allows quick and easy manipulation by a user's thumb on the spine portion of the folding knife handle to assure quick closing.

U.S. Pat. No. 6,553,672 to Glesser et al. discloses a folding knife with a compression locking mechanism, and is incorporated by reference herein in its entirety. U.S. Pat. No. 6,918,184 to Glesser discloses a folding knife lock integral stop pin, and is incorporated by reference herein in its entirety. U.S. Pat. No. 6,751,868 to Glesser discloses a folding knife with a substantially spherical locking mechanism, and is incorporated by reference herein in its entirety. U.S. Pat. No. 5,615,484 to Pittman discloses a cam lock for a folding knife blade, and is incorporated by reference herein in its entirety. U.S. Pat. No. 4,985,998 to Howard discloses a folding knife with a blade lock, and is incorporated by reference herein in its entirety.

SUMMARY OF THE INVENTION

It is thus an aspect of embodiments of the present invention to provide a folding knife locking mechanism that is secure, strong, safe, and easily released when the blade is in an extended position of use. It is a further aspect of the present invention to provide a folding knife locking mechanism with increased compression force and designed to use a minimum number of components, thus making the locking mechanism inexpensive to manufacture, simplistic in design, and encompassing a variety of different embodiments of a folding knife. The locking mechanism may comprise a toggle and a backlock. The toggle locks the blade in an extended position using compression force. It is also one aspect of embodiments of the present invention to provide a locking mechanism that is near frictionless when between open and closed positions to allow the blade to either become positioned in an open or closed position with relative ease.

Yet another aspect of embodiments of the present invention is to provide a folding knife with safe locking and unlocking features and with a reduced number of parts and components. Thus, one aspect is to provide a folding knife with a two-piece backlock that enables the blade to pivot about a fixed point, safely secures the blade in an extended position, and impedes the opening of the blade when the blade is in a closed position. Please note that "open" may be used herein interchangeably with "extended."

Thus, one aspect of various embodiments of the present invention is to provide a folding knife comprising a locking mechanism for preventing rotation of the blade by engagement with at least one surface of the tang portion of the blade, thereby securing the folding knife in an extended position of use. The locking mechanism may engage the tang of the blade to provide a compression force, which provides improved locking features.

One aspect of embodiments of the present invention is to provide a locking mechanism (e.g., a two-piece backlock) that is retained by enclosing the two-piece backlock within the handle portion of the folding knife, such as by enclosing the two-piece backlock between a pair of scales, and to provide a locking mechanism that prevents or impedes rotation when the blade is in a closed position of storage. Additionally, the locking mechanism should have improved positioning below a user's thumb for easy access. Thus, a user can unlock and release the blade with his thumb with ease and comfort.

One aspect of some embodiments of the present invention is to provide a folding knife with a locking mechanism that is biased with a leaf spring. The leaf spring or other biasing means provides a position indicator of the locking mechanism showing whether the blade is locked.

Another aspect of embodiments of the invention is to provide a folding knife with a locking mechanism. The locking mechanism is a two-piece backlock and comprises a backlock member and a toggle member positioned against at least one interior surface of the blade tang such that the two-piece backlock prevents the folding knife blade from pivoting from an open extended position to a closed position. The two-piece backlock also impedes the opening of the blade when the blade is in a closed, stored position. When the folding knife blade is in an extended position of use (also referred to herein as an "open and locked position," "a first position," or "a first extended position"), the locking mechanism is in a first locked position, the toggle is in a first locked position, and the backlock is in a first locked position. When the toggle is in the first locked position, a retaining arm of the toggle, and specifically a flat portion of the retaining arm, is positioned against a first stop surface of the tang of the blade such that the retaining arm is in compression with the tang, thereby preventing the blade from pivoting about a blade pivot point and rotating to a closed position. The first stop surface of the tang may be upwardly oriented in some embodiments. Additionally when the toggle is in the first locked position, the backlock is positioned against a notch of the toggle such that a rounded upper arm of the toggle is positioned above a forward end of the backlock and a rounded lower arm of the toggle is positioned below the forward end of the backlock. This positioning of the toggle against the tang of the blade significantly improves the strength characteristics of the locking mechanism, and more specifically it improves the knife's strength characteristics with respect to compressive force when pressure is applied to an upper portion of the knife blade.

When the folding knife is in an open position or in an intermediate position between open and closed and the user has unlocked or released the locking mechanism, the locking mechanism is in a second released position, the toggle is in a second released position, and the backlock is in a second released position. Similarly, when the folding knife is in a closed position, the locking mechanism is in a third resting position, the toggle is in a third position, and the backlock is in a third position. When the toggle is in the third position, the retaining arm of the toggle (specifically the flat portion of the retaining arm) is positioned against a second stop surface of the tang of the blade, thereby impeding the blade from pivoting about the blade pivot point beyond the blade's closed position and creating an additional safety feature which substantially prevents the inadvertent opening of the blade, and a flat surface of the tang is positioned against a curved portion of the toggle to further prevent the inadvertent opening of the blade.

In one aspect of various embodiments of the invention, a user moves the blade of a folding knife from an open position to a closed position by pushing on the handle spine near a rear end (also referred to herein as a "rear portion" or "butt end") of the backlock. As the user engages or pushes on the rear end of the backlock, the backlock rotates around a pivot point (e.g., backlock pin or rivet) to a second released position and the forward end of the backlock engages with the rounded upper arm of the toggle to rotate the toggle to a second released position. At this point, the locking mechanism is in a second released position which allows the blade to rotate to either an extended position of use or closed position of storage. The term "unlocked," as used herein, may be used interchangeably with "released." When the toggle is in the second released position, the retaining arm of the toggle disengages from the first stop surface of the tang. Thus, the locking mechanism is moved to the released position, which allows the blade to pivot about the blade pivot point to a closed position.

In one embodiment of the present invention, a two-piece backlock comprises a toggle member with arms and a backlock member. Alternatively, the two-piece backlock may comprise an alternative locking mechanism, a tooth-shaped toggle member, or a toggle member of any other imaginable shape that can be advanced by the anvil or an end of the backlock to engage the tang and also be retracted or rotated to disengage the tang.

In one embodiment, the toggle is positioned to engage one or more surfaces of the tang of the blade and a backlock, which are both positioned in close proximity to the toggle so as to prevent the locking mechanism from becoming disengaged from the one or more surfaces of the blade tang and the backlock.

In some embodiments, the backlock rear end may be proximate to one end of a biasing member. A spacer may receive the other end of the biasing member. The spacer may also be referred to as a "back spacer" herein. The biasing member may be in constant tension to limit the backlock's movement around the backlock pivot point. In one embodiment, the biasing member may be coupled to a rear portion of the backlock to provide an upward force on the rear portion of the backlock. In some embodiments, the locking mechanism, biasing member, and spacer may be concealed within the handle of the folding knife.

Thus, in one embodiment of the present invention, a folding knife with a selectively releasable locking mechanism is provided comprising: a blade moveable from a first extended position to a second closed position and having a front end, a tang on a rear end, a spine, and a cutting edge, the blade pivotally interconnected to a forward end of a handle; a locking mechanism moveable from a first locked position to a second released position, the locking mechanism comprising: a toggle positioned proximate to the forward end of the handle for selectively locking the blade in the first extended position, the toggle comprising a retaining arm and an upper arm; and a backlock. When the blade is in the first extended position the retaining arm of the toggle engages a first upwardly oriented surface of the tang. When the locking mechanism is in the second released position, the toggle disengages the first upwardly oriented surface of the tang and a forward end of the backlock engages the upper arm of the toggle. When the blade is in the second closed position the retaining arm of the toggle engages a second surface of the tang.

In an additional embodiment of the present invention, the folding knife also comprises a biasing member which biases the backlock towards the first locked position.

In another embodiment of the present invention, the backlock and an upper arm of the toggle and a lower arm of the toggle are operably engaged such that when the backlock rotates about a rotation point, the toggle rotates from a first locked position to a second released position; and the toggle comprises a retaining arm for engaging the first surface of the tang when the blade is in the first extended position, and the retaining arm of the toggle disengages the first surface of the tang when a rear portion of the backlock is pushed downwardly.

In some embodiments, the toggle is further comprised of: a rounded arm for engaging with the first end of the backlock and for rotating the toggle about a toggle rotation point; and a retaining arm with a flat portion.

According to another embodiment of the present invention, a folding knife with a locking mechanism is provided, the folding knife generally comprises: a blade having a front end, a tang on a rearward end, an upper edge, and a cutting edge, the tang of the blade pivotally interconnected to a forward end of a handle, the handle further comprising a first scale and a second scale, the scales defining a channel for receiving at least a portion of the blade; a locking mechanism comprising a toggle and a backlock, the locking mechanism pivotally interconnected to the handle for selectively locking the blade in a first extended position and selectively allowing the blade to rotate to a second closed position, the toggle comprising a retaining arm and a rounded upper arm; a forward end of the backlock positioned proximate the toggle; a stop surface of the tang; a flat portion of the retaining arm of the toggle, the flat portion adapted to provide a compression force against the stop surface of the tang when the blade is in the first extended position; and wherein when a rear portion of the backlock is pushed downwardly the backlock rotates about a backlock rotation point, the forward end of the backlock exerts an upwardly oriented force on the rounded upper arm to rotate the toggle about a toggle rotation point, and the flat portion of the retaining arm disengages the stop surface of the tang.

In one embodiment of the present invention, the toggle further comprises a rounded lower arm, and when the blade is in the first extended position the rounded lower arm engages the forward end of the backlock to prevent the forward end of the backlock from rotating downwardly.

In an additional embodiment of the present invention, the folding knife also comprises a biasing member coupled to a rear portion of the backlock, the biasing member provides an upwardly force on the rear portion of the backlock.

In one embodiment of the present invention, the toggle further comprises a rounded upper arm for engaging a forward end of the backlock such that when the backlock rotates about a backlock rotation point, the forward end of the backlock exerts an upwardly oriented force on the rounded upper arm to rotate the toggle about a toggle rotation point; and a rounded lower arm for engaging the forward end of the backlock such that when a biasing member provides the upwardly force on the rear portion of the backlock, the rounded lower arm prevents the forward end of the backlock from rotating downwardly.

In another embodiment of the present invention, when the blade is in the second closed position, the arm of the toggle engages a second stop surface of the tang to impede the opening of the blade.

In one embodiment of the present invention, a locking mechanism for a folding knife is provided comprising: a backlock comprising a first pivot aperture for receiving a first pin, the backlock rotatable about the first pin and positioned between a first scale and a second scale of a handle; a toggle comprising a second pivot aperture for receiving a second pin, a retaining arm, a rounded upper arm, and a lower arm, the toggle rotatable about the second pin; a forward end of the backlock positioned proximate the toggle; a flat portion of the retaining arm of the toggle, the flat portion adapted to provide a compression force against a stop surface of a tang of a blade when the blade is in a first extended position; and a rear portion of the backlock, wherein when the rear portion is pushed downwardly the backlock rotates about the first pin, the forward end of the backlock exerts an upwardly oriented force on the rounded upper arm to rotate the toggle about the second pin, and the flat portion of the retaining arm disengages the stop surface of the blade to allow the blade to rotate to a second closed position.

In an additional embodiment of the present invention, when the blade is in the first extended position, the lower arm engages the forward end of the backlock to prevent the forward end of the backlock from rotating downwardly.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
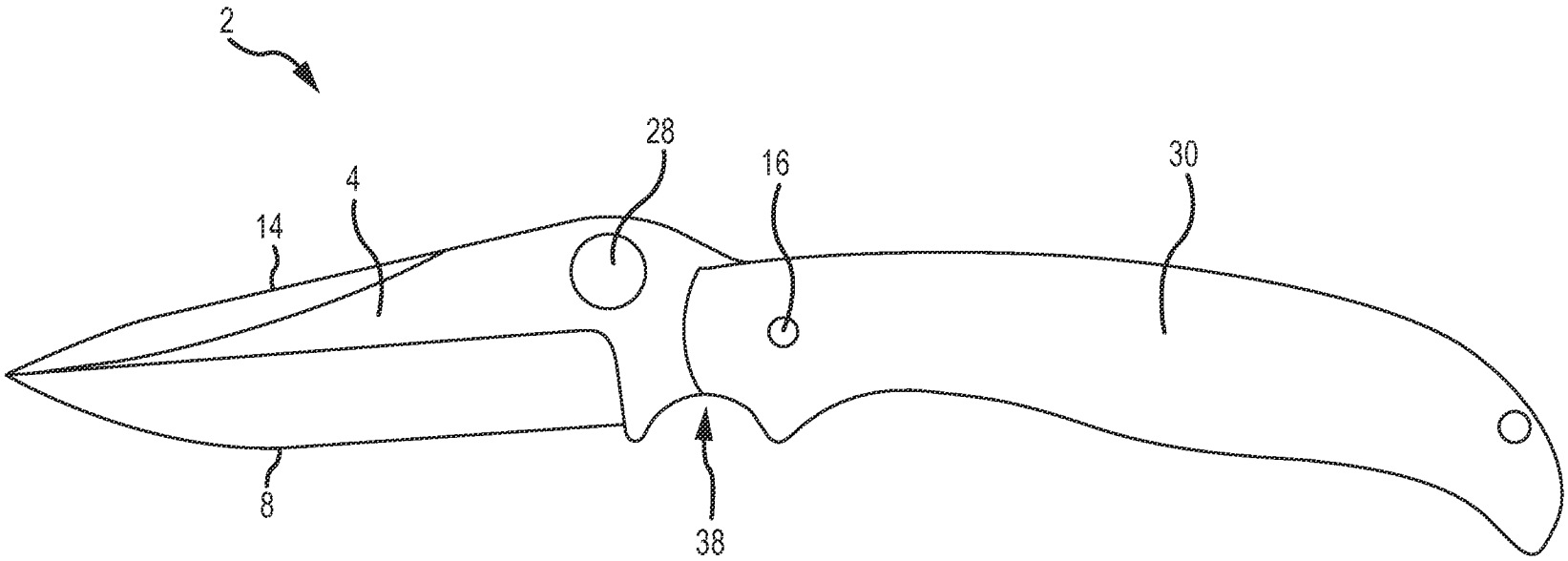
FIG. 1 is a front elevation view of a folding knife in an extended position.

To assist in the understanding of the embodiments of the present invention the following list of components and associated numbering found in the drawings is provided herein:

| Component No. | Component |
|---|---|
| 2 | Folding Knife |
| 4 | Blade |
| 6 | Vertical Edge (of Blade) |
| 8 | Cutting Edge (of Blade) |
| 10 | Thumb Traction Portion (of Blade) |
| 12 | Recessed Blade Portion |
| 14 | Spine (of Blade) |
| 16 | Blade Pivot Point |
| 18 | Notch (of Tang) |
| 20 | Backlock |
| 22 | Leaf Spring |
| 24 | Spacer |
| 28 | Finger Aperture |
| 30 | Handle |
| 32 | Second (closed) Stop Surface (of Tang) |
| 34 | Stop Pin |
| 36 | Backlock Pin (or Rivet) |
| 38 | Choil |
| 40 | Tang |
| 42 | Flat Surface (of Tang) |
| 44 | Rounded Portion (of Tang) |
| 46 | First (extended) Stop Surface (of Tang) |
| 50 | Two-Piece Backlock |
| 56 | Surface (of Tang) |
| 58 | Contact Surface (of Blade) |
| 60 | Toggle |
| 62 | Toggle Pin |
| 64 | Rounded Upper Arm (of Toggle) |
| 66 | Rounded Lower Arm (of Toggle) |
| 68 | Curved Portion (of Toggle) |
| 70 | Flat Portion (of Toggle) |
| 72 | Notch (of Toggle) |
| 74 | Retaining Arm (of Toggle) |
| 80 | Rear End (of Backlock) |

-continued

| Component No. | Component |
|---|---|
| 82 | Anvil (of Backlock) |
| 84 | Pin (of Spacer) |
| 86 | Right Scale |
| 88 | Left Scale |
| 90 | Force (by user to rotate Toggle) |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

As described in detail below, various embodiments of the present invention include novel folding knife designs and configurations, comprising a two-piece backlock and/or other features. The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed.

The blade, backlock, anvil, scales, toggle, and leaf spring may be composed of various materials known in the art. For example, some components may be metal, ceramic, plastic, fiberglass, or any other known material.

Figure 2:
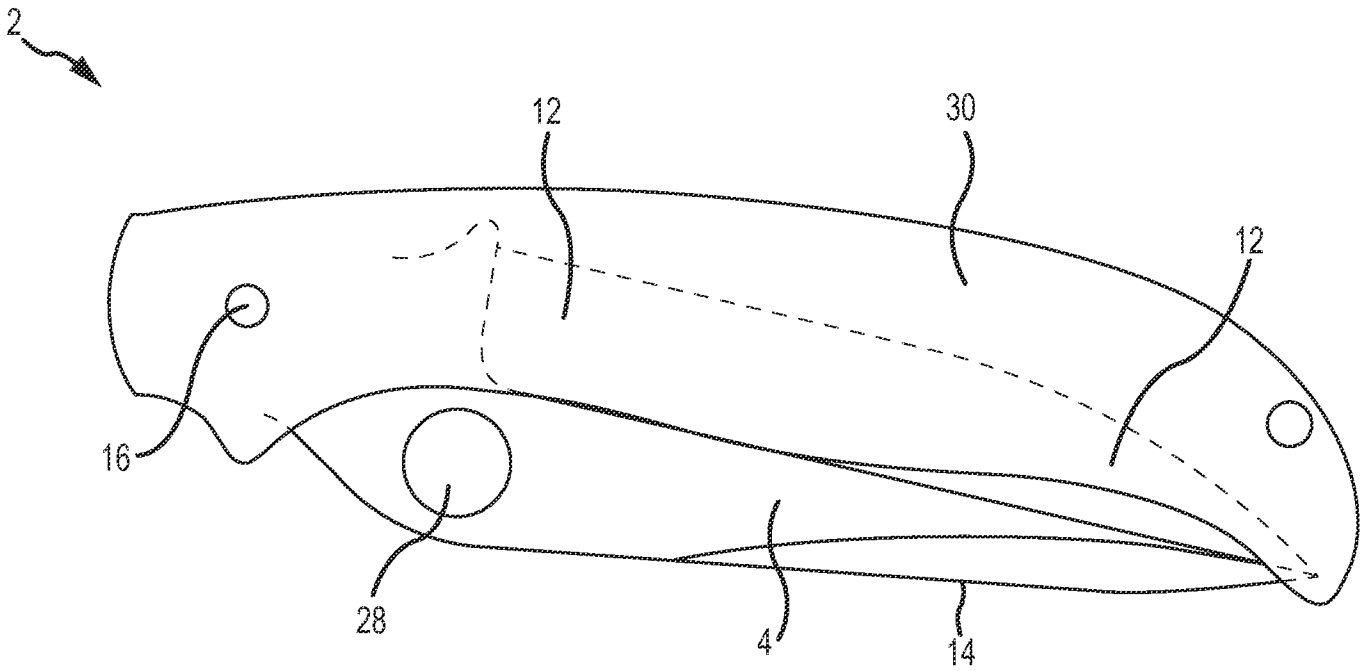
FIG. 2 is a front elevation view of the folding knife of FIG. 1, shown in a closed position.

Referring now to FIGS. 1-2, a folding knife 2 according to one embodiment of the present invention is shown. The folding knife 2 comprises a blade 4 interconnected to a handle 30, the blade is pivotable about a blade pivot point 16 allowing the blade 4 to be positioned in a closed (FIG. 2) or open (FIG. 1) position, and pivoted therebetween. The blade 4 is generally comprised of a cutting edge 8 opposite a spine 14. When the blade 4 is in the closed position, the recessed blade portion 12 is concealed within the handle 30. In some embodiments, the spine 14 of the blade 4 is exposed when the blade 4 is in the closed position. The blade may also comprise a finger aperture 28, which assists a user in rotating the blade 4 about the blade pivot point 16 from the closed position to the open position of use.

The blade 4 and handle 30 may be shaped such that they form a choil 38 on the lower side of the folding knife 2. The choil 38 may assist the user in gripping the folding knife 2. The handle 30 may comprise surfaces or machined sections of a folding knife, often referred to as scales, which are formed into the interior surface of the handle portions of the folding knife 2. In some embodiments, the handle 30 may comprise a right and a left scale. The handle 30 may also comprise a clip.

Although FIGS. 1-2 have shown a folding knife 2 comprising a handle 30, it is contemplated that a folding knife 2 according to one embodiment of the present disclosure will include a blade 4 that may be coupled to a significantly modified handle, different from the handle depicted in FIGS. 1-2, including but not limited to a handle comprised of only a first surface, but that still has the ability to secure the blade 4 in a closed position or an open position as described above (i.e., provides a blade attachment or pivot point and ability to recess the blade).

Referring to FIGS. 3-7B, the following descriptions of the positions of various components will be used herein. When the folding knife blade is in a first extended position (FIGS. 3, 5, 7A), the locking mechanism is in a first locked position, the toggle is in a first locked position, and the backlock is in a first locked position. When the folding knife is in an extended position or in an intermediate position between extended and closed and the user has unlocked or released the locking mechanism (FIG. 7B), the locking mechanism is in a second released position, the toggle is in a second released position, and the backlock is in a second released position. When the folding knife is in a second closed position (FIGS. 4 and 6), the locking mechanism is in a third resting position, the toggle is in a third position, and the backlock is in a third position.

Figure 3:
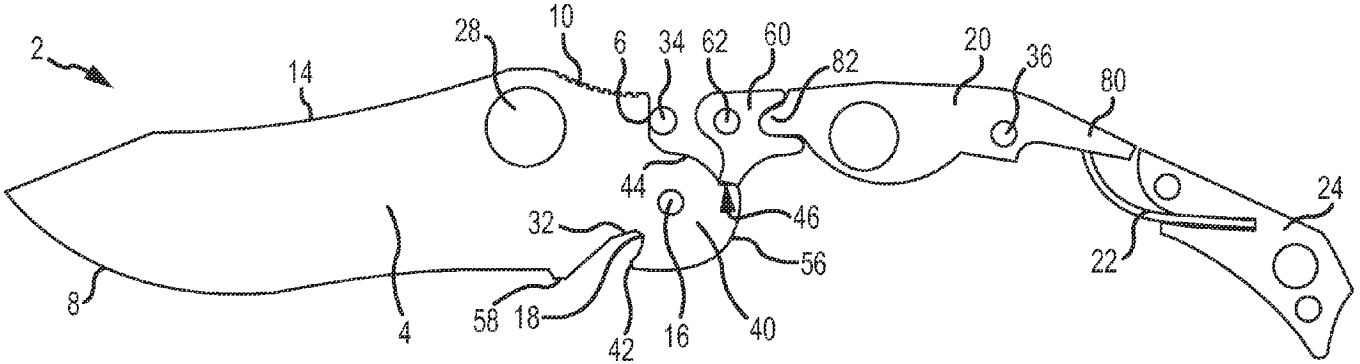
FIG. 3 is a front sectional view of a folding knife.
Figure 4:
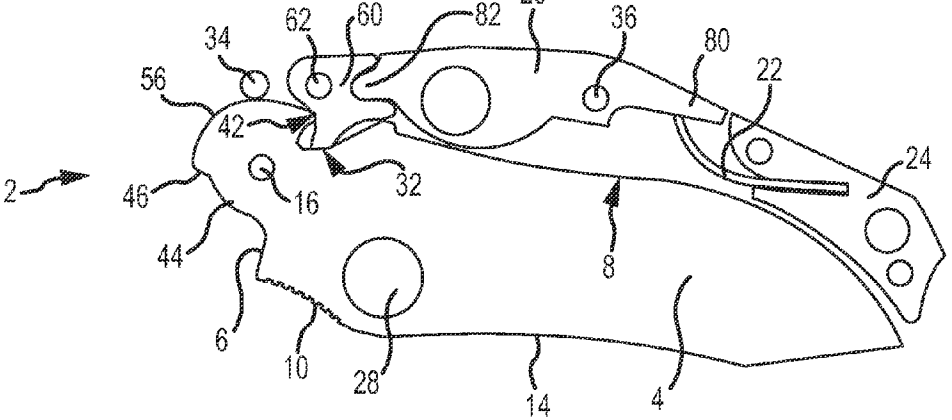
FIG. 4 is a front sectional view of the folding knife of FIG. 3, shown in a closed position.

Referring now to FIGS. 3-4, a folding knife 2 according to one embodiment of the present invention is shown. FIG. 3 shows the folding knife 2 in a first extended position and FIG. 4 shows the folding knife 2 in a closed position. The handle of the folding knife 2 is removed to show the inner components of the folding knife 2. The knife 2 may comprise a blade 4, a stop pin 34, a backlock 20, a toggle 60, a leaf spring 22, and a spacer 24 (which may also be referred to as a "back spacer" herein). The blade 4 is rotatable around a blade pivot point 16. The blade 4 may comprise a cutting end 8, a spine 14, a finger aperture 28, a thumb traction portion 10, a vertical edge 6, and a contact surface 58. The vertical edge 6 of the blade 4 may be positioned proximate to the stop pin 34 when the blade 4 is in an extended position. In some embodiments, the vertical edge 6 may rest against the stop pin 34 when the folding knife 2 is in an extended position, such that the stop pin 34 and vertical edge 6 prevent the blade 4 from rotating beyond the desired range of motion (i.e., beyond the first extended position of use).

In some embodiments, the thumb fraction portion 10 (also called a thumb ramp) is located on the spine of the blade proximate the handle. The thumb traction portion 10 gives the user's thumb some traction, which can enhance the user's grip when thrusting and stabbing. Some embodiments of the blade 4 also comprise the finger aperture 28 proximate the spine of the blade 4. The finger aperture 28 assists a user in rotating the blade 4 about the blade pivot point 16 from the closed position to the extended position of use.

The blade 4 may also comprise a rear portion generally referred to as the tang 40, which is comprised of multiple surfaces. A first stop surface 46 of the tang 40 is shown in FIG. 3 positioned against the toggle 60, which is one part of the two-piece backlock and may be positioned to allow or prevent movement of the blade 4 about the blade pivot point 16 as described herein. The tang 40 may include a curved surface 56 proximate to the blade pivot point 16. The curved surface 56 is positioned between a flat surface 42 and the first stop surface 46. The first stop surface 46 engages the toggle 60 once the blade 4 has pivoted about a blade pivot point 16 to an extended position of use, thereby securing the blade 4 in its extended position. In some embodiments, the tang 40 includes a rounded portion 44 interconnected to the first stop surface 46. The geometries of the rounded portion 44, first stop surface 46, and toggle 60 and how these geometries interact with one another also prevent the toggle 60 from rotating about a toggle pin 62 (which may also be called a "toggle rotation point" herein), which prevents the blade 4 from rotating from an extended position to a closed position. This is further described with FIG. 5.

In some embodiments, the tang 40 of the blade 4 may also include a notch 18 and a second stop surface 32. The second stop surface 32 and the contact surface 58 of the blade 4 may engage the toggle 60 when the blade 4 is in a closed position. Thus, the second stop surface 32 and the contact surface 58 prevent the blade 4 from closing beyond the desired closed position. More specifically, a flat portion 70 of a retaining arm 74 of the toggle 60 is positioned against a second stop surface 32 of the tang 40 when the blade 4 is in the closed position. Clearance between the curved surface 56 of the tang 40 and the stop pin 34 may also be necessary.

Additionally, when the blade 4 is in the closed position, the notch 18 engages the toggle 60 to impede the accidental opening of the knife blade 4. More specifically, the engagement of the retaining arm 74 with the second stop surface 32 prevents the blade 4 from inadvertently opening when the blade 4 is in the closed position. The flat surface 42 of the tang 40 is also biased against a curved portion of the toggle 60 to bias the blade 4 in the closed position. The flat surface 42 is configured to prevent the blade 4 from inadvertently opening when the blade 4 is in the closed position.

When the knife 2 is in an extended position, as shown in FIG. 3, the toggle 60 may be positioned proximate the tang 40 and proximate the backlock 20. The toggle 60 rotates around the toggle pin 62 to allow the blade 4 to move between an extended position and a closed position. When the folding knife 2 is in the extended position, the toggle 60 is positioned so that the tang 40 is biased to prevent rotation of the blade 4 about the blade pivot point 16.

In some embodiments, the backlock 20 may comprise or be interconnected to an anvil 82. The backlock 20 may also comprise a backlock rear end 80 (also referred to herein as a "rear portion") and a backlock pin or rivet 36 (which may also be called a "backlock rotation point" herein). The backlock 20 is rotatable about the backlock pin 36. The anvil 82 is positioned proximate the toggle 60 such that the anvil 82 may push on the toggle 60 to rotate the toggle 60 and allow the blade 4 to rotate about the blade pivot point 16 from the extended position to the closed position. The backlock rear end 80 may be positioned proximate to one end of the leaf spring 22. The spacer 24 may receive the other end of the leaf spring 22. The leaf spring 22 may bias the locking mechanism and may provide a position indicator of the locking mechanism showing whether the blade 4 is locked. In one embodiment, the leaf spring 22 may bias the backlock rear end 80 upward.

In some embodiments, other types of biasing members may be used in place of the leaf spring 22. For example, a traditional coil spring may be used. In one embodiment, the leaf spring 22 may be coupled to the backlock rear end 80. In other embodiments, the leaf spring 22 may be biased against the lower surface of the backlock rear end 80. Thus, the backlock rear end 80 may engage the leaf spring 22 in various embodiments. In alternate embodiments, the backlock rear end 80 may be interconnected to the leaf spring 22. The back spacer 24 may be positioned between two scales (not shown) and opposite the anvil 82. The toggle 60, backlock 20, leaf spring 22, and spacer 24 may be concealed within a handle (not shown) of the folding knife 2.

In one embodiment, the spacer 24 is coupled to the leaf spring 22. The leaf spring 22 biases the backlock 20 against the toggle 60, which is biased against the tang 40 of the blade 4. The leaf spring 22 is in constant tension, thereby causing the backlock 20 to be limited in movement around the backlock pin 36. The positioning of the backlock 20, the leaf spring 22, the anvil 82, the toggle 60, and the tang portion 40 of the blade 4 allows for the locking mechanism to be secured and retained to the components described herein, without requiring an additional exterior surface, such as scales. Some embodiments, however, may comprise scales.

The essential characteristics of the folding knife 2 according to this embodiment include the two-piece backlock 50 and the ability to pivot the blade 4 about a fixed point and secure the blade 4 in an extended position. By providing a two-piece backlock 50, with a toggle 60 and a backlock 20, a folding knife 2 may be constructed with these locking and unlocking features and, at the same time, greatly reduce the necessary parts and components previously required of folding knives. Thus, FIGS. 3 and 4 generally depict the various components required for a two-piece backlock.

In some embodiments, the two-piece backlock 50 is coupled to an interior surface of the handle of the folding knife 2 such that the handle encloses the two-piece backlock 50 and secures the two-piece backlock 50 within the folding knife 2 and adjacent the interior surface of folding knife 2.

Figure 5:
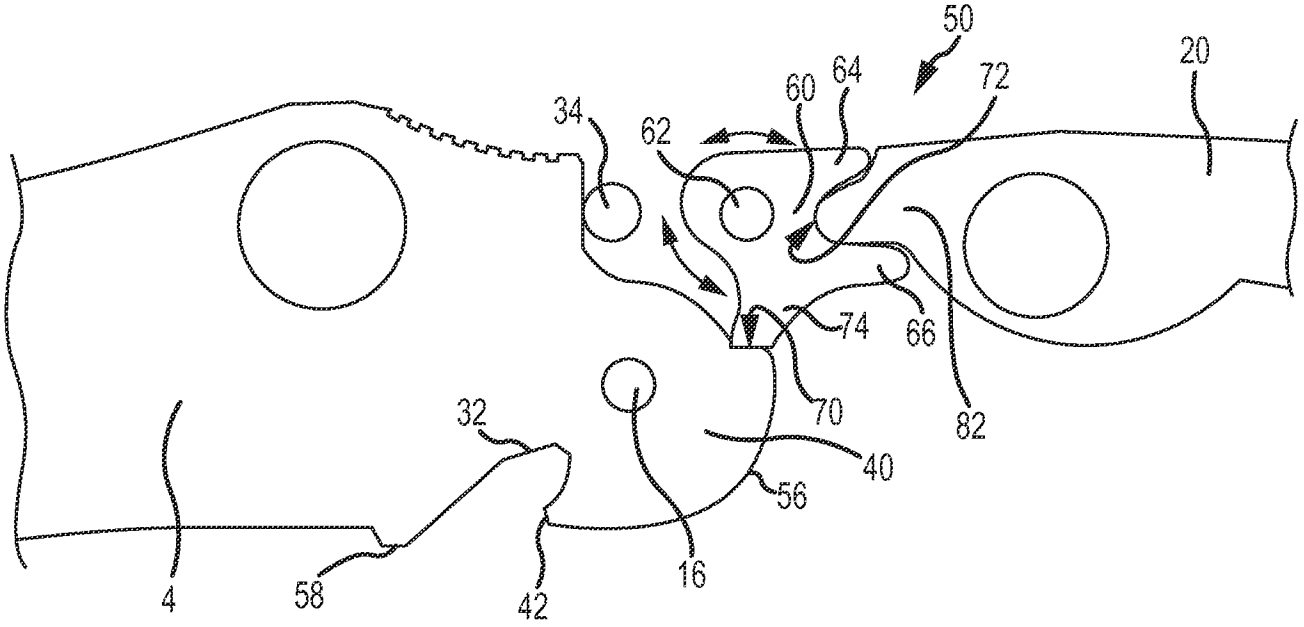
FIG. 5 is a detailed sectional front view of the two-piece backlock and tang of FIG. 3.
Figure 6:
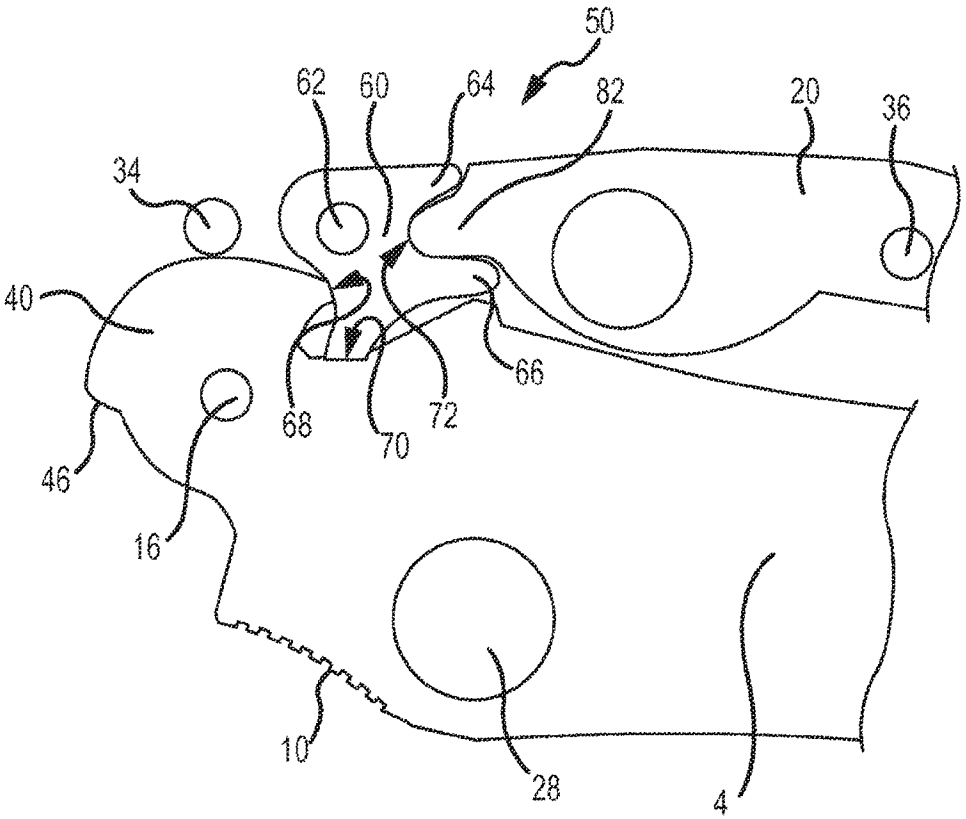
FIG. 6 is a detailed sectional front view of the two-piece backlock and tang of FIG. 5, shown in a closed position.

Referring now to FIGS. 5-6, a two-piece backlock 50 is generally comprised of a backlock 20 and a toggle 60. The toggle 60 is rotatable around a toggle pin 62 and in some embodiments the toggle 60 may comprise a rounded upper arm 64, a rounded lower arm 66, a curved portion 68, a flat portion 70, a notch 72, and a retaining arm 74. The two rounded arms 64, 66 of the toggle 60 surround an anvil 82 positioned proximate to a backlock 20 and the arms 64, 66 are positioned to rotate the toggle 60 about the toggle pin 62 when the backlock 20 is rotated about a backlock pin 36. The rounded lower arm 66 prevents the anvil 82 and/or the forward end 80 of the backlock 20 from rotating downward. The rounded lower arm 66 also keeps the anvil 82 positioned within the notch 72 of the toggle 60. This position allows the anvil 82 to push upward on the upper arm 64 of the toggle 60 and rotate the toggle 60, which releases the retaining arm 74 from a first stop surface 46 of the tang 40 and allows the blade 4 to rotate about a blade pivot point 16 to a closed position. The toggle 60 is positioned such that the toggle retaining arm 74 is biased against the tang 40 of the blade 4 to prevent the blade 4 from rotating about the blade pivot point 16 to a closed position when the blade 4 is in an open position of use (FIG. 5). The toggle 60 also engages with the anvil 82, which prevents movement of the backlock 20 except as limited by the generally clockwise rotation about the backlock pin 36 as viewed in FIGS. 5 and 6. The location of the anvil 82 within the notch 72 of the toggle 60 and the retaining arm 74 adjacent the tang 40 further bias the toggle.

In some embodiments, when the blade 4 is in the extended position, the flat portion 70 of the toggle 60 is biased against the first stop surface 46 of the tang 40. The geometries of the rounded portion 44, the first stop surface 46, and the toggle 60 and how these geometries interact with one another prevent the blade 4 from rotating about the blade pivot point 16. As can be seen in FIGS. 3 and 5, the rounded portion 44 of the tang 40 interconnects with the first stop surface 46 at an obtuse angle forming a corner-like interconnection point. The retaining arm 74 of the toggle 60 comprises a flat portion 70 near a distal end of the retaining arm 74. In some embodiments the distal end of the retaining arm 74 is not rounded; rather, it has squared corners and a flat portion 70. One corner of the retaining arm 74 rests in the obtuse angle formed at the corner-like interconnection point of the tang 40. The rounded portion 44 of the tang 40 prevents the retaining arm 74 from moving in a clockwise direction about the toggle pin 62, which, therefore, prevents the toggle 60 from rotating in a clockwise direction about the toggle pin 62. Thus, if the toggle 60 cannot rotate, then the tang 40 cannot rotate and allow the blade 4 to close. Accordingly, the intersection of one squared corner of the retaining arm 74 and the obtuse angle of the tang 40 assist in the functionality of the two-piece backlock 50.

When the blade 4 is in a closed position (FIG. 6), the flat portion 70 of the toggle 60 is biased against a second stop surface 32 of the tang 40 and a lower surface of the rounded lower arm 66 is positioned against the contact surface 58 of the blade 4. Additionally, a flat surface 42 of the tang 40 is biased against the curved portion 68 of the toggle 60. The flat surface 42 is configured to ride along the curved portion 68 of the toggle 60 during travel from a closed position to an open position. In some embodiments, a curved surface 56 of the tang 40 is configured to ride along a stop pin 34 when the blade 4 is traveling from an extended position to a closed position or vice versa. In other embodiments, space is required between the curved surface 56 of the tang 40 and the stop pin 34.

In some embodiments, in addition to the two arms 64, 66 for surrounding the anvil 82, a portion of the notch 72 of the toggle 60 that contacts the anvil 82 may be slightly concave to provide another means for engaging the anvil 82 and toggle 60. Additionally or alternatively, the retaining arm 74 and the flat portion 70 of the toggle 60, which contacts the first stop surface 46 of the tang 40, may be slightly concave to provide another means for engaging the tang 40 to secure the blade 4 in the extended position. In other embodiments, the first stop surface 46 of the tang 40 may be straighter and flatter than is shown in FIGS. 5 and 6 to further secure the blade in the open position.

This configuration provides several advantages over prior art knives. For example, using compression to engage the toggle 60 and the tang 40 provides greater strength than backlocks of the prior art. The locking mechanism is really strong where the force of the toggle 60 (specifically the flat portion 70 of the retaining arm 74) pushes on the tang 40. Thus, the locking mechanism is strong and secure. Additionally, the configuration helps retain the blade 4 in the closed position through the engagement of the tang 40 and the toggle 60 when the blade 4 is in the closed position.

In some embodiments when the blade 4 is in a closed position (FIGS. 4 and 6), the two-piece backlock 50 does not prevent the blade from moving to an extended position. In the closed position, the flat portion 70 of the toggle 60 is positioned against the second stop surface 32 of the tang 40. Additionally, the flat surface 42 of the tang 40 is positioned against the curved portion 68 of the toggle 60 to bias the blade 4 in the closed position. Thus, the flat portion 70 may slide along the blade 4 and the flat surface 42 may slide along the toggle 60 as the blade moves from a closed position to an extended position. A user may use a finger aperture 28 to rotate the blade 4 about the blade pivot point 16 from a closed position to an extended position of use. In some embodiments, the blade 4 comprises a thumb traction portion 10 to give the user's thumb fraction to enhance the user's grip.

Figure 7A:
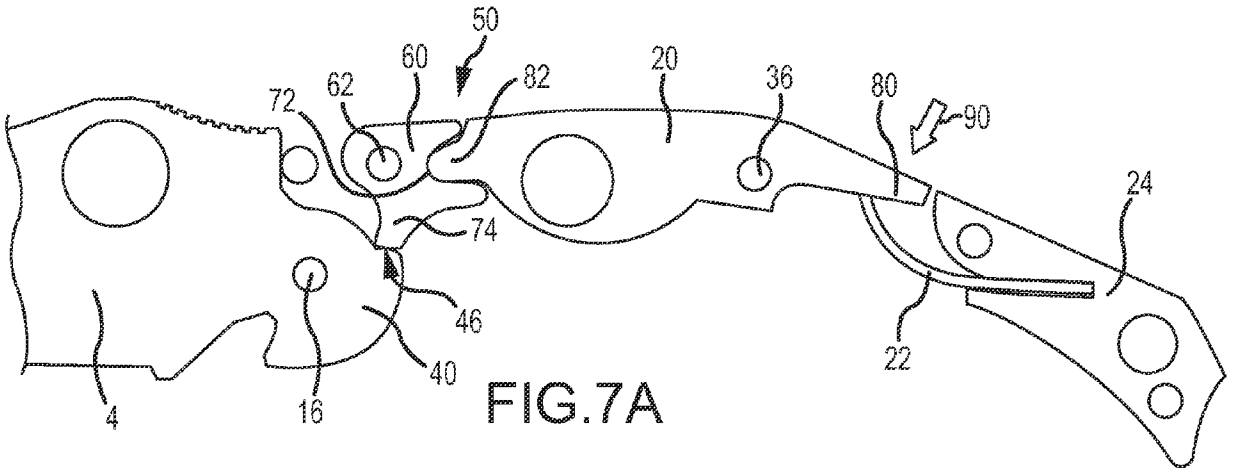
FIG. 7A is a sectional front view of the folding knife of FIG. 3.
Figure 7B:
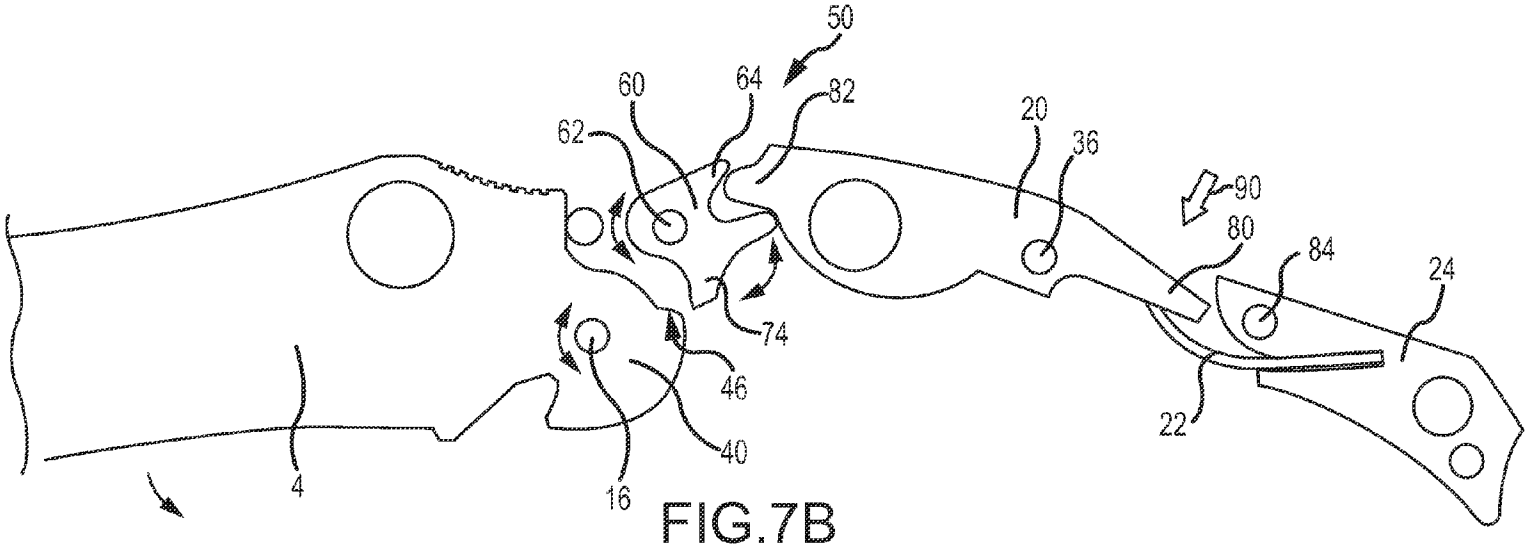
FIG. 7B is a sectional front view of the folding knife of FIG. 7A, shown in an unlocked position.

Referring to FIGS. 7A-7B, a two-piece backlock 50 allows for selective rotation of a blade 4 around a blade rotation point 16. In some embodiments the two-piece backlock 50 comprises a toggle 60 and a backlock 20. The two-piece backlock 50 is movable from a first locked position (FIG. 7A) to a second released position (FIG. 7B) in rotational directions. In one embodiment, a spacer 24 is coupled to a leaf spring 22, which biases the two-piece backlock 50 against a tang portion 40 of the blade 4. The backlock 20 is further coupled to an anvil 82, which is positioned against a notch 72 of the toggle 60. The spacer 24 may be interconnected to a handle by a pin 84.

When the folding knife is in an open position of use, the two-piece backlock 50 is in a first locked position (FIG. 7A), the toggle 60 is in a first locked position, and the backlock 20 is in a first locked position. In this position, the toggle 60 prevents the blade 4 from rotating around the blade pivot point 16 from an extended position to a closed position because a retaining arm 74 of the toggle is biased against a first stop surface 46 of the tang 40. Thus, the tang 40 cannot rotate counterclockwise (as viewed in FIGS. 7A and 7B) around the blade pivot point 16 because the toggle 60 prevents such rotation when the blade 4 is in an extended position and the toggle 60 is in a locked position. The tang 40 cannot rotate counterclockwise because of the geometries of the tang 40 and the toggle 60, and the toggle 60 cannot rotate clockwise because of the position of the backlock 20 between the arms of the toggle 60. Further, the toggle 60 is prevented from rotating around a toggle pin 62 by the backlock 20 and the anvil 82.

As shown in FIG. 7B, a user may unlock the two-piece backlock 50 to move the blade 4 from an extended position to a closed position. To release or unlock the two-piece backlock 50, the user must exert a force 90 on the upper surface (or spine) of the handle proximate a rear end 80 of the backlock 20. The user may exert the force 90 by pushing on the rear end 80 of the backlock 20 with his thumb. When the user exerts the force 90 on the rear end 80 of the backlock 20, the backlock 20 rotates around a backlock pin 36. Because the anvil 82 may be secured to the backlock 20 in some embodiments, the anvil also rotates around the backlock pin 36 when the rear end 80 rotates. The anvil 82 pushes upward on a rounded upper arm 64 of the toggle 60. Thus, the push by the anvil 82 causes the toggle 60 to rotate around the toggle pin 62 and disengages the retaining arm 74 of the toggle 60 from the first stop surface 46 of the tang 40. At this point, the tang 40 and the blade 4 are free to rotate about the blade pivot point 16 to a closed position. When the folding knife is in an open position or in an intermediate position between extended and closed and the user has unlocked or released the two-piece backlock 50 (FIG. 7B), the two-piece backlock 50 is in a second released position, the toggle 60 is in a second released position, and the backlock 20 is in a second released position.

In use, this configuration allows the two-piece backlock 50 to travel in generally rotational directions and selectively be positioned in either a locked or an unlocked position, thereby allowing the tang 40 to selectively be retained or to rotate about the blade pivot point 16. The toggle 60 rotates about the toggle pin 62 between a first locked position, a second released position, and a third position. The backlock 20 rotates about the backlock pin 36 between a first locked position, a second released position, and a third position. The rotations of the toggle 60 and the backlock 20 allow a user to secure the blade 4 in an extended position of use or to store the blade 4 in a closed position.

Although the two-piece backlock 50 shown in FIGS. 3-7B is one shape, other embodiments may use differently shaped two-piece backlocks to secure the blade in an open position. The positioning of the toggle 60, the backlock 20, the anvil 82, and the tang 40 provide the framework to prevent the two-piece backlock 50 and tang 40 from becoming disengaged or removed from the knife housing.

Figure 8:
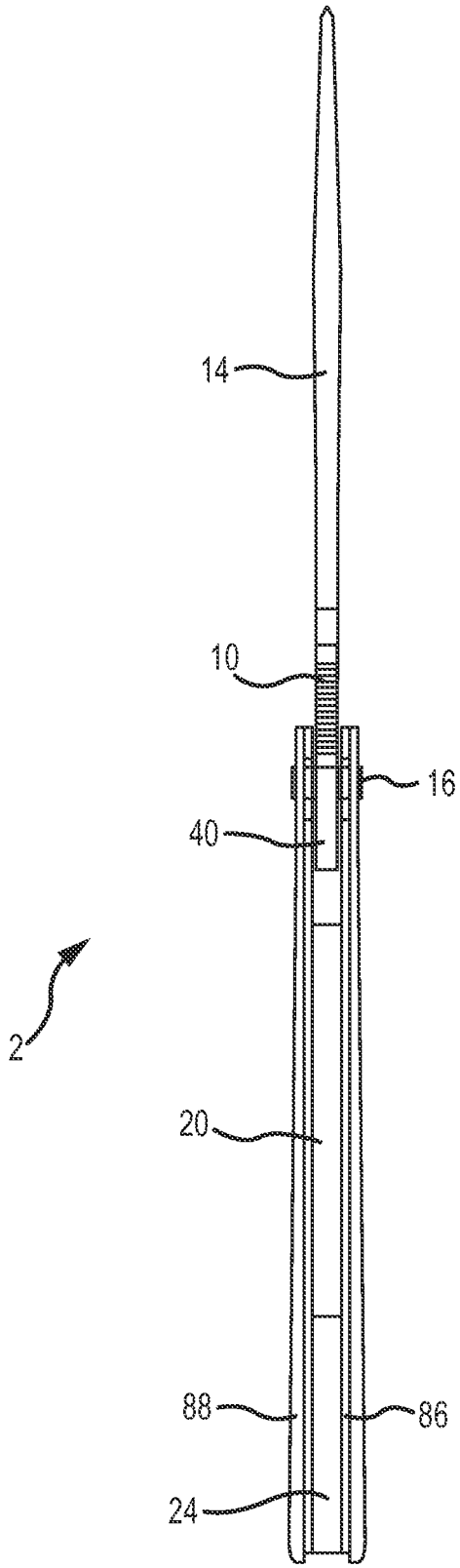
FIG. 8 is top plan view of a folding knife in an extended position.

FIG. 8. is a top plan view of a folding knife 2. The folding knife 2 may comprise a blade 4, a blade pivot point (e.g., a pin or rivet) 16, a backlock 20, a spacer 24, a right scale 86, and a left scale 88. The blade 4 may comprise a spine 14, a thumb traction portion 10, and a tang 40. The thumb traction portion 10 gives the user's thumb some traction, which can enhance the user's grip when thrusting and stabbing. The scales 86, 88 define a channel for receiving at least a portion of the blade 4.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A folding knife with a selectively releasable locking mechanism, comprising:

a blade moveable from a first extended position to a second closed position and having a front end, a tang on a rear end, a spine, and a cutting edge, said blade pivotally interconnected to a forward end of a handle;

a locking mechanism moveable from a first locked position to a second released position, said locking mechanism comprising:

a toggle positioned proximate to said forward end of said handle for selectively locking said blade in said first extended position, said toggle comprising a retaining arm and an upper arm; and a backlock;

wherein when said blade is in said first extended position said retaining arm of said toggle engages a first upwardly oriented surface of said tang;

wherein when said locking mechanism is in said second released position said toggle disengages said first upwardly oriented surface of said tang and a forward end of said backlock engages said upper arm of said toggle;

wherein when said blade is in said second closed position said retaining arm of said toggle engages a second surface of said tang; and wherein said backlock operable engages said upper arm of said toggle and a lower arm of said toggle such that when said backlock rotates about a rotation point, said toggle rotates from a first locked position to a second released position.

2. The knife of claim 1, wherein said backlock is pivotally interconnected to said handle.

3. The knife of claim 1, further comprising a biasing member which biases a rear portion of said backlock upwardly.

4. The knife of claim 1, wherein said retaining arm of said toggle disengages said first upwardly oriented surface of said tang when a rear portion of said backlock is pushed downwardly.

5. The knife of claim 1, wherein said upper arm is rounded and engages with said forward end of said backlock to rotate said toggle about a toggle rotation point, and wherein said retaining arm comprises a flat portion.

6. The knife of claim 1, wherein when said blade is in said second closed position, a cutting edge of said blade is stored within said handle.

7. The knife of claim 1, wherein said retaining arm of said toggle is in compression with said first upwardly oriented surface of said tang when said blade is in said first extended position.

8. A folding knife with a locking mechanism, comprising:

a blade having a front end, a tang on a rearward end, an upper edge, and a cutting edge, said tang of said blade pivotally interconnected to a forward end of a handle, said handle further comprising a first scale and a second scale, said first and second scales defining a channel for receiving at least a portion of said blade;

a locking mechanism comprising a toggle and a backlock, said locking mechanism pivotally interconnected to said handle for selectively locking said blade in a first extended position and selectively allowing said blade to rotate to a second closed position, said toggle comprising a retaining arm and a rounded upper arm;

a forward end of said backlock positioned proximate said toggle;

a stop surface of said tang;

a flat portion of said retaining arm of said toggle, said flat portion adapted to provide a compression force against said stop surface of said tang when said blade is in said first extended position; and wherein when a rear portion of said backlock is pushed downwardly said backlock rotates about a backlock rotation point, said forward end of said backlock exerts an upwardly oriented force on said rounded upper arm to rotate said toggle about a toggle rotation point, and said flat portion of said retaining arm disengages said stop surface of said tang.

9. The folding knife of claim 8 further comprising a biasing member to provide an upwardly oriented force on said rear portion of said backlock.

10. The folding knife of claim 8 further comprising a spacer positioned between said first and second scales and proximate said rear portion of said backlock.

11. The folding knife of claim 8, wherein when said blade is in said second closed position, said retaining arm of said toggle engages a second stop surface of said tang to impede opening of said blade.

12. The folding knife of claim 8, wherein when said blade is in said second closed position, a third flat surface of said tang engages a curved portion of said toggle to impede opening of said blade.

13. The folding knife of claim 8, wherein said forward end of said backlock comprises an anvil positioned between said first and second scales and proximate said toggle.

14. The folding knife of claim 8, wherein said toggle further comprises a rounded lower arm, and when said blade is in said first extended position said rounded lower arm engages said forward end of said backlock to prevent said forward end of said backlock from rotating downwardly.

15. A locking mechanism for a folding knife, comprising:

a backlock comprising a first pivot aperture for receiving a first pin, said backlock rotatable about said first pin and positioned between a first scale and a second scale of a handle;

a toggle comprising a second pivot aperture for receiving a second pin, a retaining arm, a rounded upper arm, and a lower arm, said toggle rotatable about said second pin;

a forward end of said backlock positioned proximate said toggle;

a flat portion of said retaining arm of said toggle, said flat portion adapted to provide a compression force against a stop surface of a tang of a blade when said blade is in a first extended position; and a rear portion of said backlock, wherein when said rear portion is pushed downwardly said backlock rotates about said first pin, said forward end of said backlock exerts an upwardly oriented force on said rounded upper arm to rotate said toggle about said second pin, and said flat portion of said retaining arm disengages said stop surface of said tang of said blade to allow said blade to rotate to a second closed position.

16. The locking mechanism of claim 15, wherein said forward end of said backlock comprises an anvil positioned proximate said toggle.

17. The locking mechanism of claim 15, wherein when said blade is in said second closed position, said retaining arm of said toggle engages a second stop surface of said tang to impede opening of said blade.

18. The locking mechanism of claim 15, wherein when said blade is in said second closed position, a third flat surface of said tang engages a curved portion of said toggle to impede opening of said blade.

19. The locking mechanism of claim 15, wherein when said blade is in said first extended position said lower arm of said toggle engages said forward end of said backlock to prevent said forward end of said backlock from rotating downwardly.

* * * * *